United States Patent [19]

Batelka

[11] Patent Number: 4,570,546

[45] Date of Patent: Feb. 18, 1986

[54] MULTI-SCORED TAB SLIP SHEETS

[75] Inventor: Joseph J. Batelka, Wayne, N.J.

[73] Assignee: Union Camp Corporation, Wayne, N.J.

[21] Appl. No.: 609,096

[22] Filed: May 10, 1984

[51] Int. Cl.[4] ..... B32B 3/02

[52] U.S. Cl. ..... 108/51.1; 428/157; 428/167

[58] Field of Search ..... 108/51.1, 901; 428/156, 428/157, 167, 43

[56] References Cited

U.S. PATENT DOCUMENTS

| | | | |
|---|---|---|---|
| 2,209,825 | 7/1940 | Mazer | 428/167 |
| 3,776,145 | 12/1973 | Anderson et al. | 108/51.1 |
| 4,121,316 | 10/1978 | Perry | 428/167 X |
| 4,380,564 | 4/1983 | Cancio et al. | 428/167 |

*Primary Examiner*—Alexander S. Thomas

*Attorney, Agent, or Firm*—Kane, Dalsimer, Kane, Sullivan and Kurucz

[57] ABSTRACT

A slip sheet to hold a unitized load of products which sheet is provided with a tab to be gripped to move the sheet and load to any desired location, the said tab having multi-scores which permit the projecting tab in use to assume a rounded configuration and not damage projects on adjacent loads.

7 Claims, 8 Drawing Figures

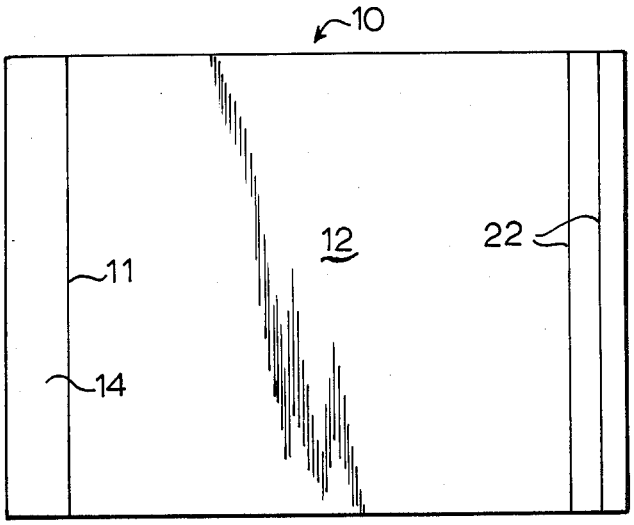
FIG.1
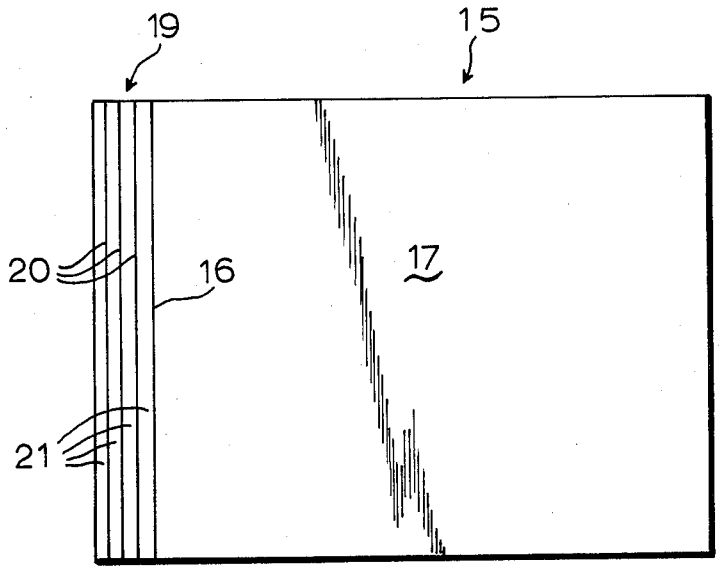
FIG.4
FIG.2
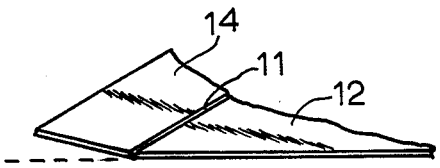
FIG.5
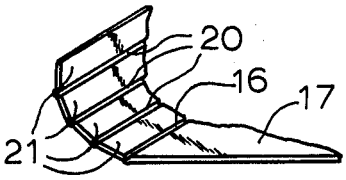

MULTI-SCORED TAB SLIP SHEETS

BACKGROUND OF THE INVENTION

1. Field of the Invention

The invention relates to pallets and more particularly to slip sheets which serve as a unitizing base for a stack of boxes or similar packaged products and which are provided with multi-scored tabs which in use assume a rounded springback configuration so that the projecting tab will not damage products on adjacent loads.

2. Brief Description of the Prior Art

The use of slip sheets is well known. They are ordinarily made of flat sheets of solid fibre board, corrugated board or plastic. In use, a slip sheet serves as a load bearing unit base for a stack of boxes or similarly packaged products that are placed upon it. A special type of front end attachment is required for handling unitized loads on slip sheets. Thus, a lift truck carrying a platen is provided with a special push-pull attachment which overlies the platen. This attachment includes a transverse front plate wall which extends to just beyond the leading edge of the platen and retracts to the opposite back plate of the push-pull attachment. A gripper bar along the lower edge of the front plate will grip a pull tab at the edge of the slip sheet to assist in holding the sheet and its load while the front plate is retracting and the load is being pulled onto the platen. The front plate will thereafter extend to push the sheet and its load off the platen.

The slip sheet must be provided with at least one tab for gripping the sheet and for moving the load onto the platen, but it creates one problem. The tab projecting beyond the unitized load causes damage when it contacts the product in an adjacent load. When the tab is stiff and makes contact with the product in an adjacent load, the product is damaged by the tab before the tab bends or buckles. This is especially true when the product placement on the sheet covers the score line for the tab. Since the slip sheet may be provided with tabs on more than one side, even up to all four sides, for gripping the sheet from any side, it will be apparent that such additional tabs can compound the damage.

The slip sheet of the present invention takes care of this problem by employing a tab which is multi-scored so that it assumes a rounded springback configuration when combined with a load. Thus the tab tends to bend and buckle when the load comes into contact with an adjacent load rather than projecting into and damaging such adjacent load.

SUMMARY OF THE INVENTION

The invention comprises a slip sheet adapted to hold a unitized load of products to be gripped and moved with the load to any desired location, which sheet comprises a generally flat sheet of material scored at at least one end to define a base on which to place the load and a tab to be gripped to move the sheet, the said tab being provided with at least three score lines to define a plurality of mini-tabs which will assume a rounded springback configuration when such tab is gripped by the push-pull attachment and which provide bending loci so that the tab will bend and buckle when the load contacts an adjacent load and not cause any damage to such adjacent load. Such plurality of score lines may also extend into the base of said slip sheet.

BRIEF DESCRIPTION OF THE DRAWINGS

In the drawings:

FIG. 1 is a top plan view of a slip sheet of the prior art showing the base and integral tabs on opposite sides for gripping the sheet;

FIG. 2 is a perspective side view of a fragment of one of the tabs of the slip sheet of Fig. 1;

FIG. 4 is a top plan view of the slip sheet of the present invention showing one multi-scored tab for gripping the sheet;

FIG. 5 is a perspective side view of a fragment of the tab of the slip sheet of FIG. 4 showing the multi-scored tab in a rounded configuration;

DETAILED DESCRIPTION OF THE PREFERRED EMBODIMENT

Figure 3:
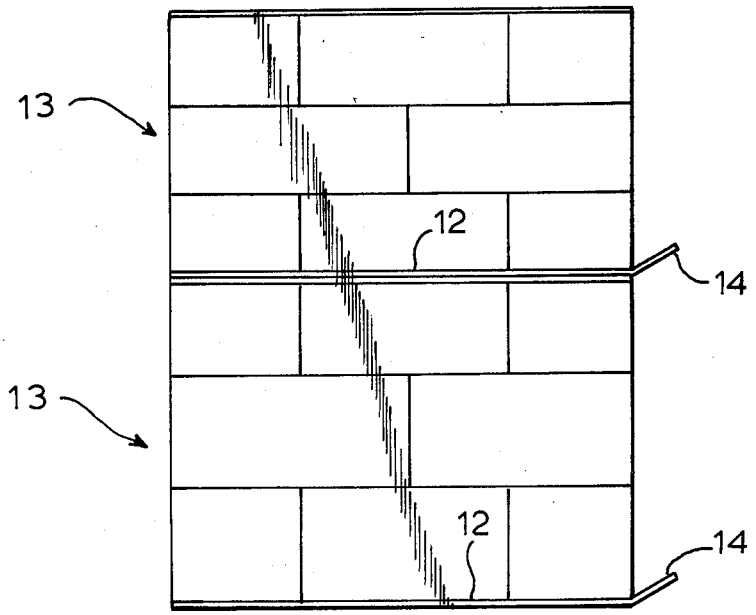
FIG. 3 is a sectional view showing two stacked unitized loads each load resting on the slip sheet of FIG. 1.

Referring to the drawings, the slip sheet of the prior art is shown in FIGS. 1, 2 and 3. The flat sheet 10 is scored along a line 11 adjacent one edge to define a base 12 on which to place the load 13 and a tab 14 to be gripped to move the sheet. When the sheet is so scored and folded and then released the tab will tend to spring back and assume a generally flat configuration. For solid fibre sheets the tab will tend to return to a 20° or less angle. Since the tab projects 3 or 4 inches from the base and is stiff it will damage the product in an adjacent load. Even if the tab has an additional score, this disadvantage will still project into an adjacent load. Because of the stiffness of the sheet, the tab will not tend to bend or buckle. This is especially true when the product placement on the base covers the tab score line 11.

To take care of this disadvantage of the conventional slip sheet, the tab was provided with multiple scores throughout the entire tab area with the score lines no more than one inch apart. This is illustrated in FIG. 4 where the flat sheet 15 is scored along a line 16 adjacent one edge to define a base 17 on which to place the load 18 and a tab 19 to be gripped to move the sheet. The tab 19 is scored along lines 20 parallel to the tab score line 16 with such score lines 20 no more than one inch apart to provide a plurality of mini-tabs 21. The advantages of such multi-scores in the tab are 1. It provides tab flexibility without adversely affecting the tensile strength which is a primary functional requirement of slip sheets.

2. The additional score lines in the tab provide easy-to-bend areas even if the product placement covers the traditional tab score line.

3. The multi-scores allow the tab to arch or to accordian fold when it contacts another object or load.

Figure 6:
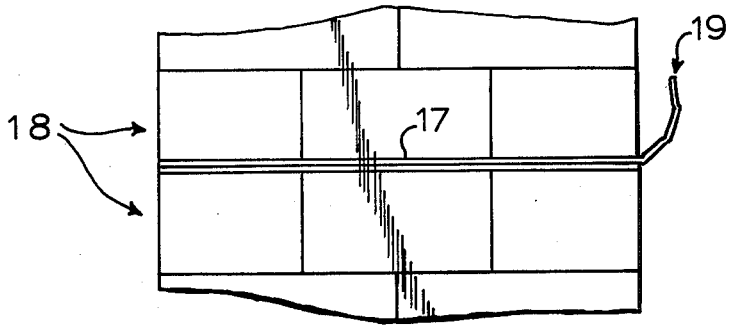
FIG. 6 is a sectional fragmentary view showing two stacked unitized loads with the slip sheet of FIG. 4 interposed between the loads.

4. A paper product which is scored and folded and then released will tend to spring back and assume a flat configuration. These solid fiber sheets tend to return to a 20° or less angle. This is true at each score line. The multi-scored tab then tends to assume a rounded springback configuration which is the sum of the angles at each score. This is illustrated and contrasted in FIGS. 2 and 5. This rounded configuration allows the multi-score concept to easily bend out of the way before product damage occurs (FIG. 6). Trial runs of the multi-scored slip sheets confirmed that the tabs assumed a rounded shape and bent and buckled readily under contact. Nevertheless, such sheet retained its tab configuration so that the machine handling of the load was not impaired due to excessive buckling. The multi-score tab did not produce product damage even in paper wrapped products.

Figure 4A:
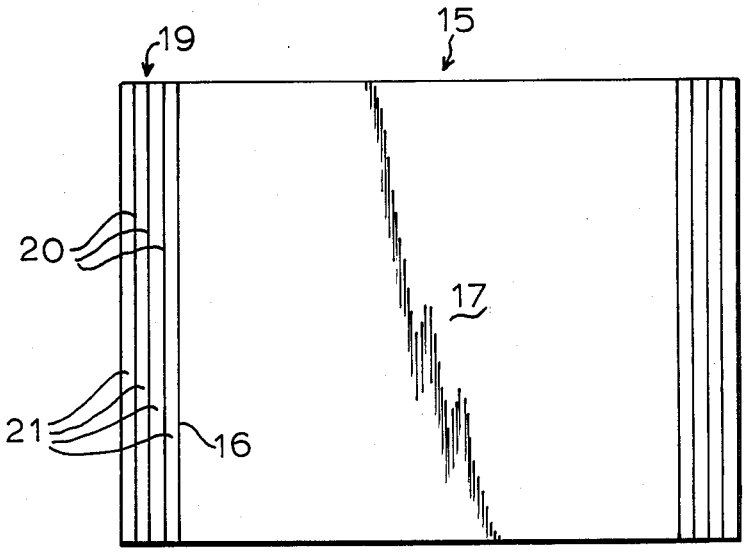
FIG. 4A is a view similar to that of FIG. 4 of the slip sheet of the present invention showing multi-scored tabs on opposite sides of the slip sheet.

It will be understood that slip sheets as described herein can be provided with a single tab or with tabs on one or more edges of the sheet so that the slip sheet can be gripped from any side. FIG. 4A illustrates duplicate tabs on opposite sides.

Figure 7:
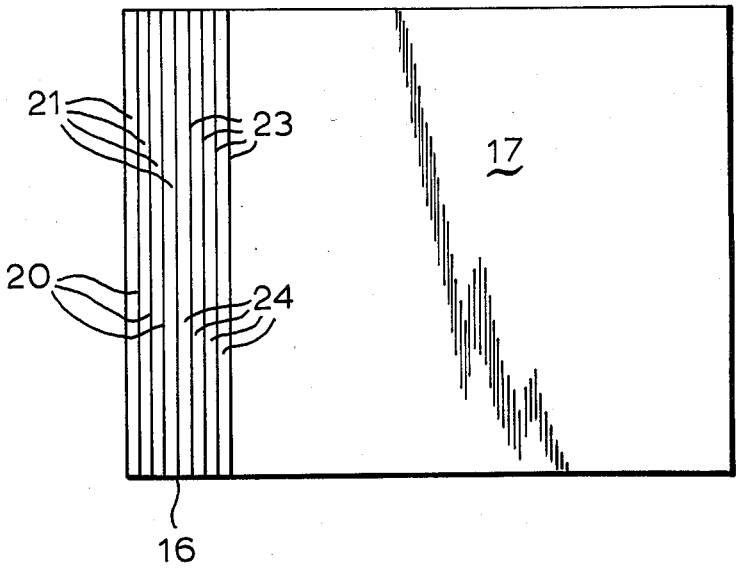
FIG. 7 is a view similar to that of FIG. 4 showing a modified form of slip sheet in which the base is scored to provide mini-tabs in the base as well as in the adjacent tab.

In FIG. 1 the tab 14 is shown along one edge of the sheet. The additional scores 22 on the opposite edge are provided to a given slip sheet to be used for different pallet sized loads. This can also be achieved by the construction shown in the modified form of slip sheet of FIG. 7. The base adjacent the tab is multi-scored along lines 23 parallel to the first line between the base and the tab so that the base will be provided with a plurality of mini-strips 24 similar to the mini-tabs. These mini-strips will serve the same purpose as the mini-tabs so that the tab will not project into an adjacent load but will bend and buckle and not cause any damage to such adjacent load.

Those skilled in the art will appreciate that many variations of the above described embodiment of the invention may be made without departing from the spirit and scope of the invention.

What is claimed is:

1. A slip sheet, which serves as a unitizing base to hold a load of products and to be gripped and moved with the load to any desired location, comprising:

a generally flat sheet of relatively stiff paperboard material scored at one end along a first line generally parallel to the edge of the sheet to define a base on which to place the load and a tab projecting from the base and load to be gripped to move the sheet;

the said tab being scored along at least three secondary score lines parallel to the first line to define a plurality of mini-tabs not exceeding one inch in width which will assume a rounded springback configuration when the slip sheet is combined with a unitized load;

whereby each secondary score line acts as a bending loci so that the tabs will bend and buckle when the load contacts an adjacent load and not cause any damage to such adjacent load.

2. The slip sheet of claim 1 in which the material is solid fiberboard.

3. The slip sheet of claim 1 in which the material is corrugated board.

4. The slip sheet of claim 1 in which there are duplicate tabs on opposite sides of the sheet.

5. The slip sheet of claim 1 in which there are duplicate tabs on all four sides of the sheet.

6. The slip sheet of claim 1 in which the base adjacent the tab is scored along lines parallel to the first line to define a plurality of mini-strips not exceeding one inch in width in the base.

7. The slip sheet of claim 1 in which there are duplicate tabs on adjacent sides of the sheet.

* * * * *